US005121880A

United States Patent [19]

Adams et al.

[11] Patent Number: 5,121,880

[45] Date of Patent: Jun. 16, 1992

[54] MODE SELECTOR FOR A HEATING SYSTEM CONTROLLER

[75] Inventors: John T. Adams, Minneapolis; T. Michael Tinsley, Coon Rapids, both of Minn.

[73] Assignee: Honeywell Inc., Minneapolis, Minn.

[21] Appl. No.: 504,960

[22] Filed: Apr. 5, 1990

[51] Int. Cl.[5] ..... F24D 3/00; F23N 5/00

[52] U.S. Cl. ..... 237/12; 431/24; 340/578

[58] Field of Search ..... 431/24, 25, 26, 27, 431/29; 237/2 A, 8 R, 12, 2 R, 2 B, 3, 4, 5, 7, 8 A, 8 B, 10, 11; 340/578

[56] References Cited

U.S. PATENT DOCUMENTS

| | | | |
|---|---|---|---|
| 4,239,478 | 12/1980 | Tanaka et al. | 431/24 |
| 4,384,844 | 5/1983 | Yamamoto et al. | 431/14 |
| 4,389,184 | 6/1983 | Tanaka et al. | 431/15 |
| 4,448,033 | 5/1984 | Briccetti | 62/126 |
| 4,482,006 | 11/1984 | Anderson | 165/11 |
| 4,644,266 | 2/1987 | Reuter | 324/73 |
| 4,674,291 | 6/1987 | Kitauchi | 62/126 |
| 4,685,615 | 8/1987 | Hart | 236/94 |
| 4,975,683 | 12/1990 | Parsons et al. | 431/24 X |

*Primary Examiner*—Henry A. Bennet
*Attorney, Agent, or Firm*—Edward Schwarz

[57] ABSTRACT

A heating system controller is suitable for controlling a heating system based on a plurality of sensed control signals representing control parameters. The heating system controller has a first input suitable for being coupled to provide a control signal. The heating system controller also includes a sensor, coupled to the first input, for sensing control signals at the first input, the control signals having a first pattern, a second pattern, or a third pattern detected over at least two successive time periods. The heating system controller includes a control mechanism, coupled to the sensor for controlling the heating system based on the first, second and third patterns. The control mechanism causes the controller to change modes when the third pattern is sensed.

40 Claims, 4 Drawing Sheets

MODE SELECTOR FOR A HEATING SYSTEM CONTROLLER

BACKGROUND OF THE INVENTION

The present invention relates to controlling a heating system. More particularly, the present invention relates to a method and apparatus for causing a heating system controller to change modes of operation.

There are many uses for industrial heating systems such as ovens, furnaces and boilers. Many such heating systems are sold by Original Equipment Manufacturers (OEM's). However, before OEM's can sell such heating systems, they are generally required to check out the operation of the heating system for any flaws. In order to check out the heating system, the OEM's cause the heating system controller to control operation of the heating system such that the heating system is run through a check-out sequence. During the check-out sequence, the heating system controller exercises all critical functions of the heating system so that check-out personnel can verify correct operation of the heating system and controller.

Some heating systems are controlled by a microprocessor. Therefore, in order to cause the heating system controller to perform the check-out sequence, a signal must be provided to the microprocessor so the microprocessor can enter a check-out mode.

In the past, there were several techniques for causing the microprocessor to enter the check-out mode. In one technique, the microprocessors used in heating system controllers had a designated pin for receiving the check-out mode signal. Upon receiving a check-out mode signal, the microprocessor would change from a normal operation mode to a check-out mode during which it cycled through the check-out sequence. In a second technique, heating system controllers had extra hardware added to facilitate the change between the normal mode of operation and the check-out mode. By manipulating inputs to this extra hardware, the OEM operator could command the microprocessor to enter the check-out mode.

However, as heating system controllers have become more complex, and as more control parameters are sensed by the heating system controller in controlling the heating system, the availability of pins on the microprocessor used in the heating system controller has declined. Also, the amount and complexity of the extra hardware required to accomplish the change between a normal operation mode and a check-out mode has increased. This has caused heating system controller hardware to grow to an undesirable size, or in some cases, has caused heating system controller manufacturers to increase the number of pins available on the microprocessor unit used in the heating system controller. For example, some heating system controllers now require a 40 pin microprocessor rather than a 28 pin processor. Both the increase in hardware and the increase in processor size are costly in terms of space and component cost.

For these reasons, there is a continuing need for the development of improved techniques for causing heating system controllers to change between a normal operation mode and a check-out mode. Further, there is a continuing need for developing these techniques which use no extra microprocessor pins and no extra hardware.

SUMMARY OF THE INVENTION

The present invention relates to a heating system controller suitable for controlling a heating system based on a plurality of sensed control signals representing control parameters. The heating system controller includes a first input, suitable for being coupled to provide a control signal, and sensing means coupled to the first input. The sensing means senses control signals, in a first pattern, a second pattern and a third pattern, where each pattern requires two successive time intervals to be sensed. The heating system controller also includes control means coupled to the sensing means for controlling the heating system based on the first pattern, the second pattern and the third pattern. The control means causes the controller to change modes when the third pattern is sensed.

DETAILED DESCRIPTION OF THE PREFERRED EMBODIMENTS

Figure 1:
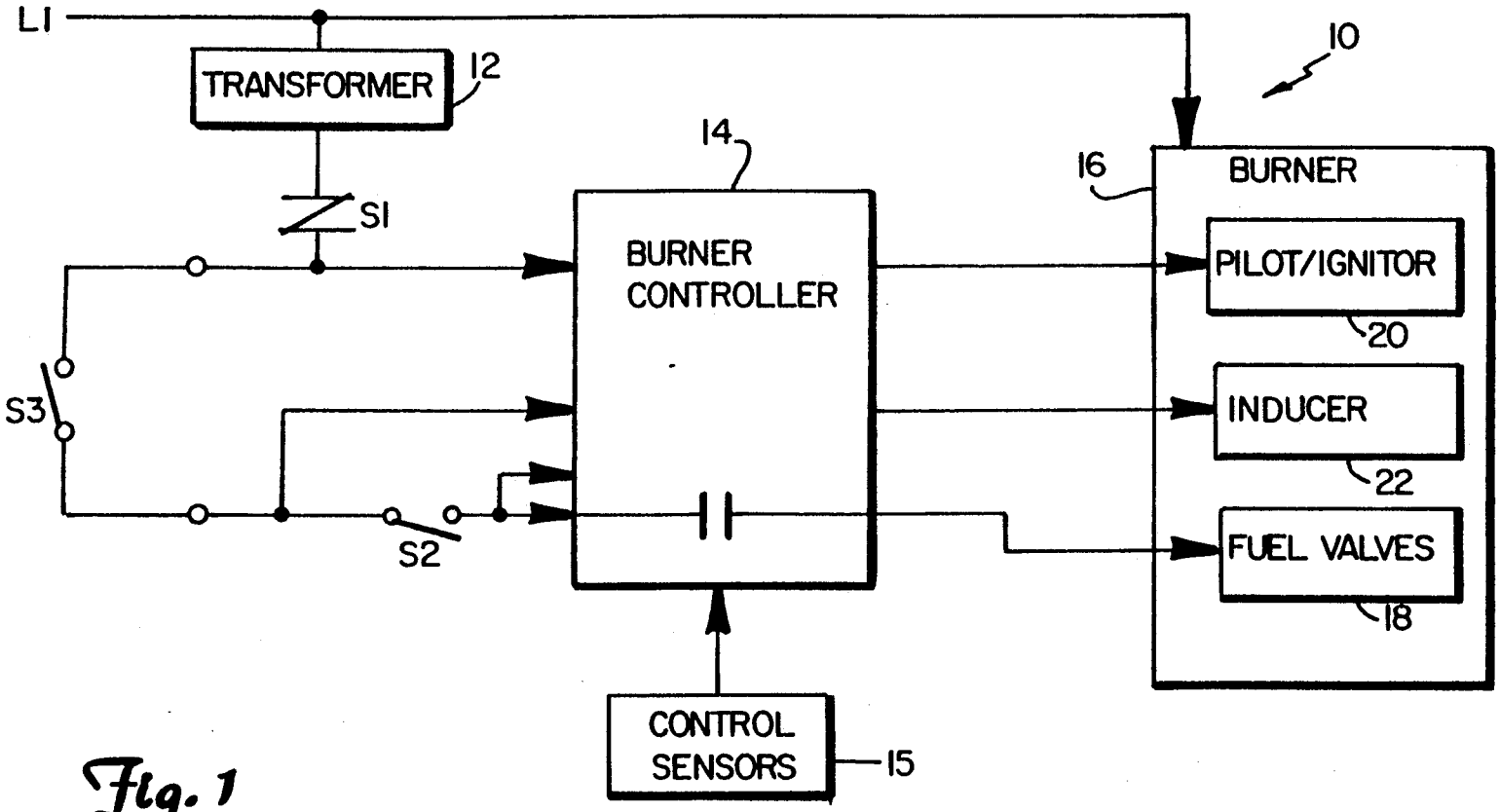
FIG. 1 is a block diagram of a heating system.

FIG. 1 is a block diagram of heating system 10. Heating system 10 includes transformer 12, switches S1, S2, and S3, burner controller 14, control sensors 15 and burner 16. Burner controller 14 controls the operation of burner 16 based on control parameter signals received through switches such as switches S1, S2 and S3 as well as sensor signals received from control sensors 15. The control parameter signals represent control parameters which are sensed at burner 16 or which are operator selected parameters.

Burner 16 includes various components such as fuel valves 18, pilot/igniter 20 and inducer 22. Fuel valves 18 control the flow of fuel to burner 16. Pilot/igniter 20 controls ignition of the fuel provided to burner 16, and inducer 22 controls airflow in burner 16. Burner controller 14 controls fuel valves 18, pilot/igniter 20 and inducer 22 based on the control signals received through switches S1, S2 and S3 as well as control sensors 15.

Control sensors 15 include, for example, solid state analyzers which monitor such control parameters as the presence of a flame in burner 16, heat exchanger temperature, and pressure drop across the heat exchanger.

Switches S1, S2 and S3 are typically transducer controlled contacts set up to sense various parameters in heating system 10. For simplicity's sake, one switch contact is shown for each. More typically, however, switches S1, S2 and S3 could each be a string of series-connected contacts. When the sensed parameter corresponding to a given switch is in a first state, the switch is open. When the sensed parameter is in a second state, the corresponding switch is closed. Switch S1, for example, is a high temperature limit switch that opens if the heating system overheats (e.g. during a fan failure when the fuel valves are open). Otherwise, switch S1 is closed.

Switch S2, in this preferred embodiment, is a pressure switch which senses air pressure controlled by inducer 22. For example, when inducer 22 is ON and the air pressure flowing through the combustion chamber and heating system 10 is at a sufficient level, pressure switch S2 closes. On the other hand, when there is insufficient air pressure in the combustion chamber, switch S2 opens.

Switch S3, in this preferred embodiment, is a thermostat switch. Switch S3 closes on a call for heat; otherwise, switch S3 remains open. Therefore, by monitoring the state of switches S1, S2 and S3, burner controller 14 acquires needed information to control heating system 10. Based on the states of switches S1, S2 and S3, as well as the inputs from control sensors 15, burner controller 14 commands outputs to the various components of burner 16.

Line voltage L1 (which is typically an AC voltage) is coupled to transformer 12. Transformer 12 is a step-down transformer which steps down line voltage L1 to a 24 volt AC signal. This signal is applied to one side of switches S1, S2 and S3. Therefore, when switches S1, S2 or S3 are closed, the corresponding signal at the inputs to burner controller 14 is a time-varying signal. However, the inputs to burner controller 14 are resistor-coupled to a logic low state. Therefore, when switches S1, S2 or S3 are open, the corresponding signal at burner controller 14 is a logic low signal.

Figure 2:
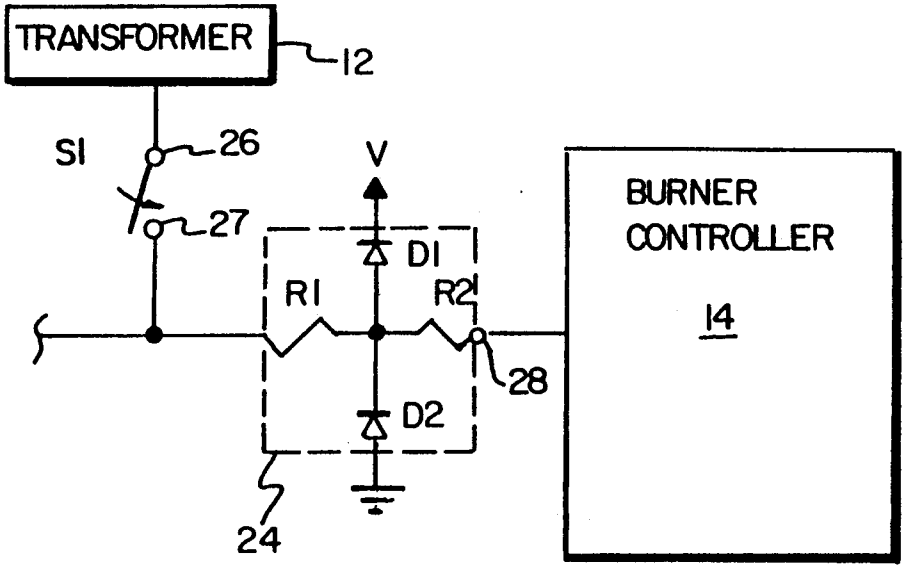
FIG. 2 is a more detailed diagram of a portion of the heating system shown in FIG. 1.

FIG. 2 is an enlarged portion of heating system 10 shown in FIG. 1. Input protection circuit 24 is shown coupled to switch S1. Input protection circuit 24 is typically coupled to each input to burner controller 14 to protect burner controller 14 from being damaged by voltage spikes caused by noise or static discharge. Input protection circuit 24 is either implemented externally to burner controller 14 or internally. Included in input protection circuit 24 are resistors R1 and R2 and diodes D1 and D2. FIG. 2 also shows switch terminals 26 and 27 and input terminal 28.

Figure 4:
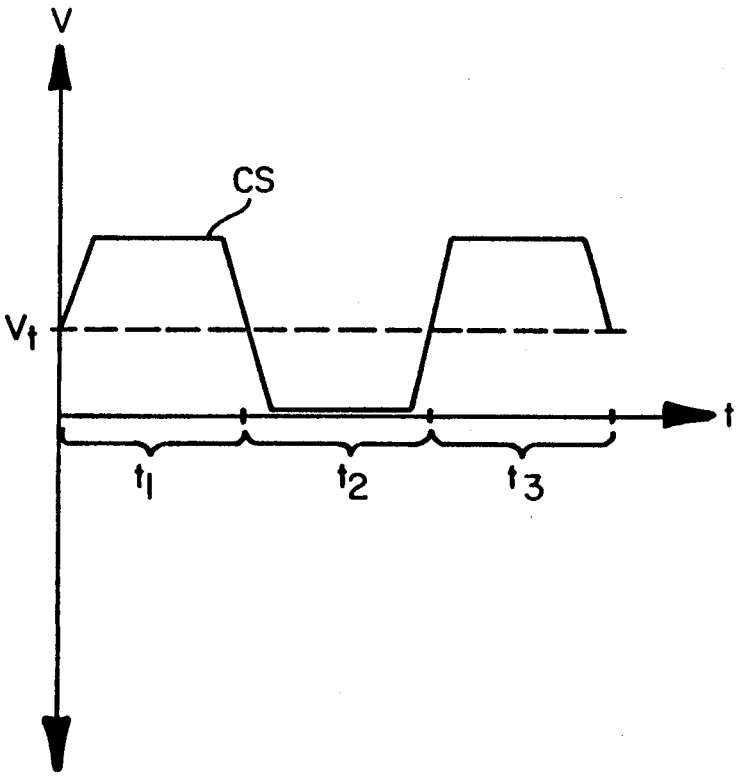
FIG. 4 is a plot of the control signal shown in FIG. 3 at a controller input.
Figure 3:
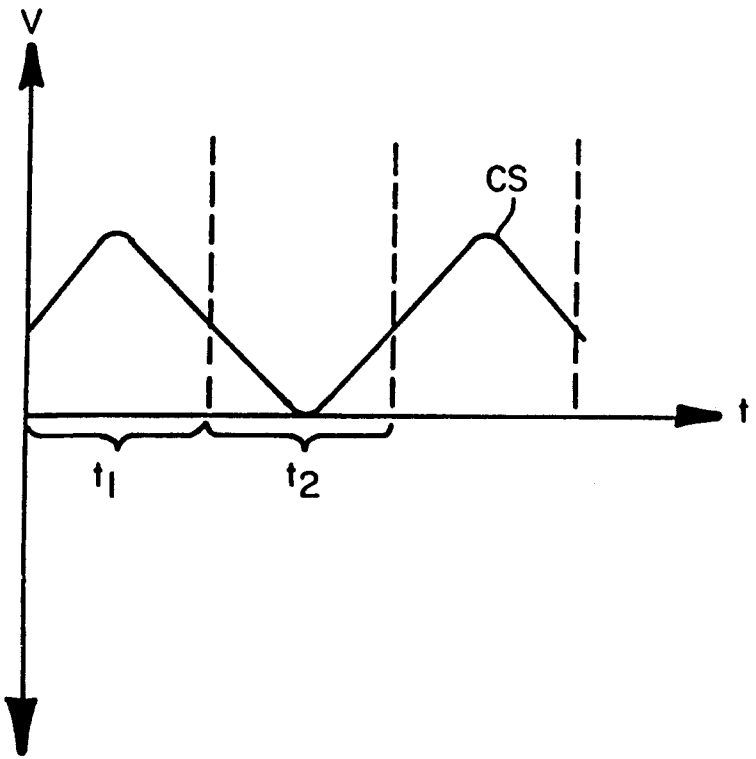
FIG. 3 is a plot of a control signal representing a control parameter in a first state.

FIG. 3 is a plot of a control signal which typically appears at switches S1, S2 and S3. In this embodiment, FIG. 3 shows a plot of the signal appearing at switch terminal 26 shown in FIG. 2. When switch S1 is closed, control signal CS, shown in FIG. 3, is applied to input protection circuit 24. FIG. 4 shows the signal appearing at input terminal 28 of burner controller 14 when switch S1 is closed. The control signal CS appearing at input terminal 28 is substantially a square wave.

Normal Operation Mode

During normal operation, burner controller 14 samples the signal appearing at input terminal 28 once each half cycle. By doing this, burner controller 14 determines the state of corresponding switch S1 and hence, the state of the sensed control parameter.

For example, burner controller 14 samples the signal appearing at input terminal 28 at approximately the midpoint of time period t1 to verify that control signal CS is above a threshold voltage $V_t$. Then, at approximately the midpoint of time period t2, burner controller 14 again samples control signal CS to verify that it is below a threshold voltage $V_t$. That control signal CS has changed states from time period t1 to time period t2 with respect to threshold voltage $V_t$ indicates to burner controller 14 that switch S1 is closed. Therefore, in this preferred embodiment, burner controller 14 determines that the system is operating below a high limit temperature.

Figure 5:
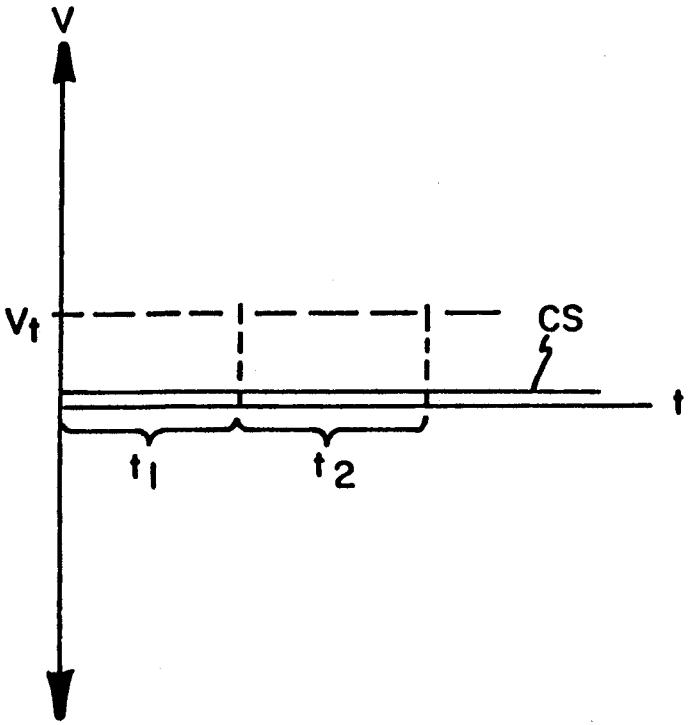
FIG. 5 is a plot of the control signal representing the parameter in a second state.

FIG. 5, on the other hand, shows control signal CS appearing at input terminal 28 which represents that the heating system is operating above the high limit temperature. When switch S1 is open, control signal CS is pulled down to a logic low level below the threshold voltage $V_t$. Therefore, during the two successive time intervals t1 and t2, control signal CS remains at a logic low level. By monitoring input terminal 28 at approximately the midpoint of time periods t1 and t2, burner controller 14 determines that switch S1 is open and, hence, that the system has overheated. Burner controller 14 monitors switches S1, S2 and S3 and determines the state of various sensor parameters in this way. Based on that information, burner controller 14 controls burner 16 accordingly.

In essence, during a normal operation mode, signals appearing at the inputs to burner controller 14 corresponding to switches S1, S2 and S3, represent control parameters which can be in one of two states. Where the heating system is operating below the high limit temperature, control signal CS representing the state of high temperature limit switch S1, which is provided at control input 28, is essentially a square wave. On the other hand, where the system has overheated and high temperature limit switch S1 is open, control signal CS provided at control input 28, is essentially a static signal which remains at a logic low level. To determine which state the particular control parameter is in, burner controller 14 must monitor the control inputs (such as control input 28) during two successive time intervals (in this case intervals t1 and t2).

Check-out Mode

Figure 6:
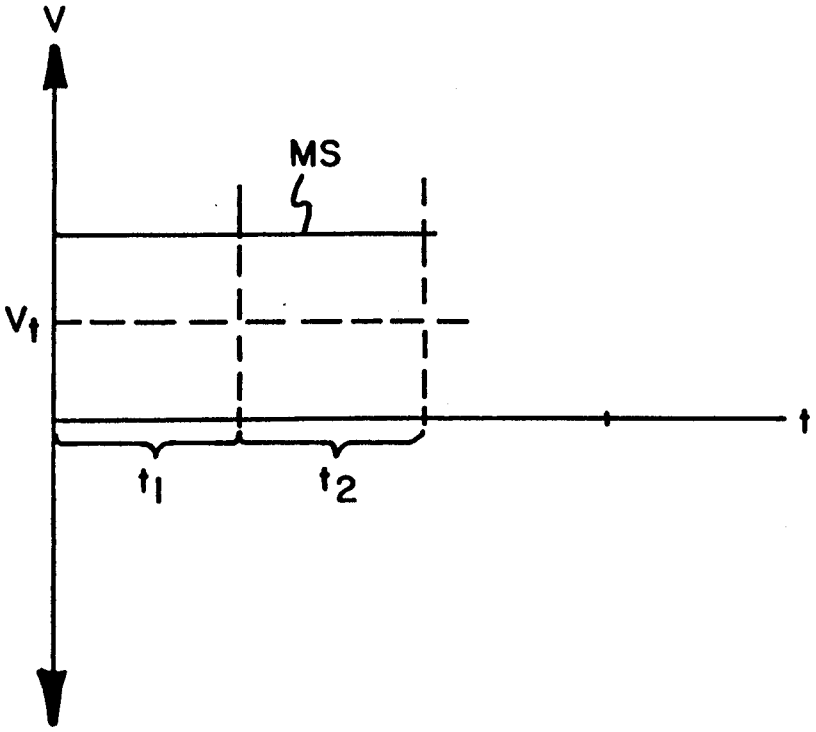
FIG. 6 is a plot of a mode signal.

Before heating system 10 is ready for normal operation, it must be checked out. This requires burner controller 14 to enter a check-out mode where it operates heating system 10 in a check-out sequence. In order to enter the check-out mode, upon power-up of heating system 10, an operator applies mode signal MS (shown in FIG. 6) to switch terminal 27 of switch S1 (shown in FIG. 2). As described earlier, burner controller 14 monitors input terminal 28 at a point near the middle of time period t1 and at a point near the middle of time period t2. Upon sensing that the signal at terminal 28 is a logic high level during both of the two successive time periods t1 and t2, burner controller 14 enters the check-out mode.

In this embodiment, the check-out mode includes a speed-up mode where a normal operation sequence is speeded up to save check-out time. During the speed-up sequence, burner controller 14 effectively cycles through and exercises all of the essential functions in heating system 10. For example, one of the functions exercised is the ignition function. A typical ignition sequence during normal operation is as follows:

| | |
|---|---|
| 30 | seconds of prepurge during which inducer 22 is turned on and the combustion chamber is ventilated to remove any fumes from unburned fuel. |
| 36 | seconds of hot surface igniter (HSI) warm-up during which a hot surface igniter is activated and brought to ignition temperature. |
| 6 | seconds of trial for ignition during which fuel is supplied to the hot surface igniter and ignition is attempted. |
| 30 | seconds of fan on delay time. |
| 102 | seconds = Total Ignition Sequence Time |

-continued

| |
|---|
| during normal operation. |

However, it is undesirable for the equipment manufacturer to be required to wait 102 seconds since the heating system is only being checked-out and not actually operating a heating system in a normal operation mode. Therefore, during check-out burner controller 14 is provided with a check-out signal, which causes burner controller 14 to exit the normal operation mode and enter a check-out mode. During the check-out mode, in this preferred embodiment, burner controller 14 cycles through the ignition sequence as follows:

5 seconds of prepurge.

12 seconds of HSI warm-up.

6 seconds of trial for ignition.

5 seconds of fan on delay time.

This reduces the ignition check-out sequence time from 102 seconds to 28 seconds. Even though the sequence time is reduced, the manufacturer is still able to check out all critical ignition functions.

Burner controller 14 is programmed so that it only recognizes mode signal MS upon power-up of heating system 10. Therefore, if, during normal operation, switch terminal 27 is somehow short-circuited to a logic high voltage level, controller 14 detects a heating system fault rather than a valid mode signal. This allows the mode selection technique of the present invention to be used safely by both OEM check-out personnel as well as service or other maintenance personnel. Also, by utilizing the input corresponding to switch S1 not only to indicate the state of the high temperature limit switch, but also as a mode input, burner controller 14 needs no extra pins or external hardware-implemented logic to accommodate a test mode signal input.

Also, it should be noted that input terminal 28 is not uniquely suited to operate as a mode signal input. The mode signal MS (in this preferred embodiment, a logic high signal) could be applied to any input to burner controller 14 where the signal appearing at the input during normal operation represents two states of a control parameter where one state is represented by a first signal pattern (in this case, an alternating signal over two successive time periods which changes states between the two consecutive time periods t1 and t2) and where the second state is represented by a second signal pattern (in this case, a logic low level) for the two consecutive time periods t1 and t2. It should also be noted that, upon receiving the mode signal MS, burner controller 14 could be programmed to enter any type of check-out mode such as a mode where the manufacturer simply tests fan speeds, proves pressure switches or tests air flow capacity of inducer 22. The speed-up mode is merely one preferred alternative.

Conclusion

In the present invention, burner controller 14 in heating system 10 is configured to recognize three signal patterns over two successive time intervals t1 and t2. The first signal pattern is a time varying signal, substantially a square wave. Control signal CS is monitored by burner controller 14 during each of the two successive time intervals t1 and t2 and moves between a first logic level (above threshold level $V_t$ to a second logic level (below threshold level $V_t$). When burner controller 14 senses this first signal pattern, burner controller 14 determines that switch S1 is closed and that the particular control parameter being sensed (in this case heating system temperature) is in a first state (below the high temperature limit).

The second pattern, in this preferred embodiment, is substantially a steady state signal at a logic low level for the two successive time intervals t1 and t2. Upon sensing the second pattern, burner controller 14 determines that switch S1 is open and the particular control parameter being sensed is in a second state (above the high temperature limit).

However, burner controller 14 is also configured for sensing a third signal pattern. This is the signal pattern of mode signal MS shown in FIG. 6. When burner controller 14 senses signal MS, it switches modes of operation. Since burner controller 14 is only configured to recognize the third signal pattern upon power-up, or within a predetermined period after power-up, burner controller 14 is prevented from switching modes of operation during a normal heating cycle.

Although the present invention has been described with reference to preferred embodiments, workers skilled in the art will recognize that changes may be made in form and detail without departing from the spirit and scope of the invention.

What is claimed is:

1. A method of controlling operation of a heating system in a first mode and a in second mode which differs from the first mode, the heating system of the type having control inputs for providing control parameter signals representing control parameters, the method comprising:

monitoring the control parameter signal provided by at least one control input for at least a first and second time period to sense a first, a second, or a third signal pattern;

controlling operation of the heating system in the first mode if the first or second signal pattern is sensed; and controlling operation of the heating system in the second mode if the third signal pattern is sensed.

2. The method of claim 1 wherein the step of controlling operation of the heating system in the second mode comprises:

controlling the heating system in a check-out mode.

3. The method of claim 2 wherein the step of controlling the heating system in a check-out mode is only performed if the third signal pattern is sensed within a predetermined power-up time period.

4. The method of claim 2 wherein the first signal pattern represents a first state of the control parameter sensed and the second signal pattern represents a second state of the control parameter sensed and wherein the step of controlling operation of the heating system in the first mode comprises:

controlling the heating system in a normal operation mode based on the state of the control parameters sensed.

5. The method of claim 4 wherein the step of controlling operation of the heating system in a first mode further comprises:

causing the heating system to perform a plurality of heating system functions in a normal operation period different from a check-out period.

6. The method of claim 5 wherein the step of controlling the heating system in a check-out mode comprises:

causing the heating system to perform the plurality of heating system functions in the check-out operation period.

7. The method of claim 6 wherein the check-out operation period is shorter than the normal operation period.

8. The method of claim 1 wherein the control parameter signal changes states from the first time period to the second time period during the first signal pattern.

9. The method of claim 8 wherein the control parameter signal remains substantially in a first state for the first and second time periods during the second signal pattern.

10. The method of claim 9 wherein the control parameter signal remains substantially in a second state for the first and second time periods during the third signal pattern.

11. The method of claim 10 wherein the first signal pattern comprises substantially a square wave.

12. The method of claim 10 wherein the first state comprises a logic low level.

13. The method of claim 10 wherein the second state comprises a logic high level.

14. The method of claim 8 wherein the first signal pattern comprises substantially an AC signal.

15. A heating system controller having a plurality of operating modes for controlling a heating system based on a plurality of control signals representing sensed control parameters, the heating system controller comprising:

a first input suitable for being coupled to provide a control signal;

sensing means, coupled to the first input, for sensing control signals at the first input, the control signals having a first pattern, a second pattern or a third pattern, wherein each pattern requires at least two successive time periods to be sensed; and control means, coupled to the sensing means for controlling the heating system based on the first pattern, the second pattern and the third pattern, the control means causing the controller to change modes when the third pattern is sensed.

16. The heating system controller of claim 15 wherein the first pattern represents a first state of the control parameter sensed.

17. The heating system controller of claim 15 wherein the second pattern represents a second state of the control parameter sensed.

18. The heating system controller of claim 15 wherein the control means comprises:

normal operation control means for controlling the heating system in a normal operation mode having at least one operation of at least a first preselected length, based on the state of the control parameter sensed when the control signal is sensed in the first or second pattern.

19. The heating system controller of claim 18 wherein the control means comprises:

check-out mode control means for controlling the heating system in a check-out mode having at least one operation of less than the first preselected length, when the control signal is sensed in the third pattern.

20. The heating system controller of claim 19 wherein the check-out mode control means is configured to control the heating system in the check-out mode only when the third pattern is sensed within a power-up time period.

21. The heating system controller of claim 15 wherein the control signal further comprises:

a varying control signal which changes states from the first of the two successive time periods to the second of the two successive time periods during the first pattern.

22. The heating system controller of claim 21 wherein the control signal remains substantially in a first state for the two successive time periods during the second pattern.

23. The heating system controller of claim 22 wherein the control signal remains substantially in a second state for the two successive time periods during the third pattern.

24. The heating system controller of claim 23 wherein the first pattern comprises substantially a square wave.

25. The heating system controller of claim 23 wherein the first pattern comprises substantially an AC signal.

26. The heating system controller of claim 23 wherein the first state comprises a logic low level.

27. The heating system controller of claim 23 wherein the second state comprises a logic high level.

28. A method of detecting a command to change operational modes of a heating system controller, the heating system controller having a normal operation mode and a check-out operation mode different from the normal operation mode and controlling operation of the heating system during the normal operation mode by monitoring a plurality of control input signals at control inputs and controlling the heating system based on those control input signals, the control input signals representing control parameters and having a first pattern over at least two successive time periods when the corresponding control parameter is in a first state, and having a second pattern over at least two successive time periods when the corresponding control parameter is in a second state, the method comprising:

sensing a mode signal applied to at least one of the control inputs for at least two successive time periods, the mode signal having a third pattern over the two successive time periods.

29. The method of claim 28 wherein the control input signal changes states between a first logic level and a second logic level from one of the successive time periods to the next during the first pattern, wherein the control input signal remains substantially at the first logic level for the two successive time periods during the second pattern and wherein the step of sensing a mode signal comprises:

sensing the mode signal at the second logic level for at least the two successive time periods.

30. The method of claim 28 wherein the control input signal comprises substantially a square wave during the first pattern, wherein the control input signal comprises substantially a steady state signal at a first logic level during the second pattern and wherein the step of sensing the mode signal comprises:

sensing substantially a steady state signal at a second logic level.

31. The method of claim 30 wherein the first logic level comprises a logic low level and wherein the step of sensing substantially a steady state signal comprises:

sensing substantially a logic high level for at least the two successive time periods.

32. The method of claim 28 and further comprising:

entering a check-out mode upon sensing the mode signal.

33. The method of claim 32 wherein the step of entering a check-out mode is only performed if the mode signal is sensed within a power-up time period.

34. The method of claim 32 wherein the check-out mode comprises a speed-up mode.

35. A method of changing operational modes of a heating system controller, the heating system controller controlling operation of the heating system in a normal operation mode different from a check-out mode by monitoring a plurality of control input signals at control inputs and controlling the heating system based on the control input signals, the control input signals representing control parameters and having a first pattern when the corresponding control parameter is in a first state, and having a second pattern when the corresponding control parameter is in a second state, the method comprising:

sensing a mode signal applied to at least one of the control inputs, the mode signal having a third pattern; and entering the check-out mode of operation upon sensing the mode signal having the third pattern.

36. The method of claim 35 wherein the step of entering a check-out mode comprises:

entering a speed-up mode of operation wherein a series of operations are performed at an accelerated rate.

37. The method of claim 35 wherein the step of entering a check-out mode is only performed if the mode signal is sensed within a power-up time period.

38. The method of claim 35 wherein the control input signal changes states between a first logic level and a second logic level from a first successive time period to a second successive time period during the first pattern, wherein the control input signal remains substantially at the first logic level for the first and second successive time periods during the second pattern and wherein the step of sensing a mode signal comprises:

sensing the mode signal at the second logic level for at least the first and second successive time periods.

39. The method of claim 35 wherein the control input signal comprises substantially a square wave during the first pattern, wherein the control input signal comprises substantially a steady state signal at a first logic level during the second pattern and wherein the step of sensing the mode signal comprises:

sensing substantially a steady state signal at a second logic level.

40. The method of claim 39 wherein the first logic level comprises a logic low level and wherein the step of sensing substantially a steady state signal comprises:

sensing substantially a logic high level for at least the first and second successive time periods.

* * * * *

UNITED STATES PATENT AND TRADEMARK OFFICE

CERTIFICATE OF CORRECTION

PATENT NO. : 5,121,880

DATED : June 16, 1992

INVENTOR(S) : John T. Adams and T. Michael Tinsley

It is certified that error appears in the above-identified patent and that said Letters Patent is hereby corrected as shown below:

Column 6, line 27, replace "a in" with --in a--;

Signed and Sealed this

Fourteenth Day of September, 1993

Bruce Lehman

*Attest:*

BRUCE LEHMAN

*Attesting Officer*

*Commissioner of Patents and Trademarks*